US005116300A

United States Patent [19]

Pildysh

[11] Patent Number: 5,116,300

[45] Date of Patent: May 26, 1992

[54] CONTAINMENT SYSTEM

[76] Inventor: Mikhail Pildysh, 30 Douglas Bank Drive S.E., Calgary, Alberta, Canada, T2Z 2B7

[21] Appl. No.: 706,346

[22] Filed: May 28, 1991

[51] Int. Cl.[5] ..... E02B 7/02

[52] U.S. Cl. ..... 405/107; 52/163; 405/114; 405/52

[58] Field of Search ..... 405/52, 107, 114, 115; 52/155, 162, 163, 169.7, 169.12, 169.14; 256/13.1, DIG. 5

[56] References Cited

U.S. PATENT DOCUMENTS

| | | | |
|---|---|---|---|
| 1,821,125 | 9/1931 | Thom | 52/163 |
| 3,031,801 | 5/1962 | Leuthesser | 52/169.7 X |
| 3,218,810 | 11/1965 | Grether et al. | 405/107 |
| 4,031,676 | 6/1977 | Dally | 405/107 X |
| 4,055,922 | 11/1977 | Ellington et al. | 52/169.7 |
| 4,136,995 | 1/1979 | Fish | 405/115 |
| 4,300,857 | 11/1981 | Santamaria | 52/162 X |
| 4,321,774 | 3/1982 | Fish | 52/169.14 X |
| 4,375,929 | 3/1983 | Clark | 405/114 |
| 4,508,319 | 4/1985 | Tappan et al. | 256/13.1 X |

*Primary Examiner*—David H. Corbin

*Attorney, Agent, or Firm*—George H. Dunsmuir

[57] ABSTRACT

In general, confinement systems of barriers for use around oil or other storage tanks are expensive and/or difficult to install. A relatively simple protective barrier includes corrugated panels connected end-to-end to define an enclosure, a bar or cap mounted on the panels, a plurality of threaded rods for extending through the cap into the ground, an anchor for mounting on the bottom end of each rod, whereby, when the rod is pulled upwardly, the anchor engages the ground to hold the rod firmly in position, and a nut for mounting on each rod above the bar which can be tightened to push the bar and consequently the panels downwardly into the ground.

9 Claims, 5 Drawing Sheets

CONTAINMENT SYSTEM

BACKGROUND OF THE INVENTION

This invention relates to a protective barrier, and in particular to a portable ground engaging barrier.

Protective barriers such as berms or retaining walls are used, for example around oil or other fluid storage tanks and around buildings during flooding. Examples of such devices are described in U.S. Pat. Nos. 4,375,929, issued to T. B. Clark on Mar. 8, 1983 and 4,511,286, issued to N. B. Hardacre on Apr. 16, 1985. Other portable barriers include dikes formed of plastic, fiberglass or concrete sections or inflatable, rubberized fabric walls integral with a planar base defining a box-like structure for receiving a container or other hazardous liquid carrier. An example of the last of these structures is the Port-A-Berm (trade-mark) system available from Aero Tec Laboratories, Inc., Ramsey, New Jersey.

In general, existing barrier structures are somewhat bulky and consequently difficult to transport, unduly complicated requiring labour intensive installation or expensive to produce.

The object of the present invention is to overcome the above-identified problems by providing a relatively simple, easy to install, portable barrier, which utilizes inexpensive materials.

DESCRIPTION OF THE INVENTION

Accordingly, the present invention relates to a protective barrier comprising elongated panel means; cap means on said panel means; a plurality of threaded rod means for extending through said cap means into the ground anchor; means on said rod means for engaging the ground when said rod means is pulled upwardly; and nut means for mounting on the top end of said rod means above said cap means, whereby, when said anchor means is in a ground engaging position and the nut means is tightened, the nut means and cap means press said panel means into the ground.

The rod and anchor means referred to above are part of the earth anchor device described in applicant's copending Canadian patent application filed April , 1991. Of course, other earth anchors having a similar structure can be used in the barrier of the present invention.

BRIEF DESCRIPTION OF THE INVENTION

The invention will be described in greater detail with reference to the accompanying drawings, which illustrate a preferred embodiment of the invention, and wherein.

DESCRIPTION OF THE PREFERRED EMBODIMENTS

Figure 1:
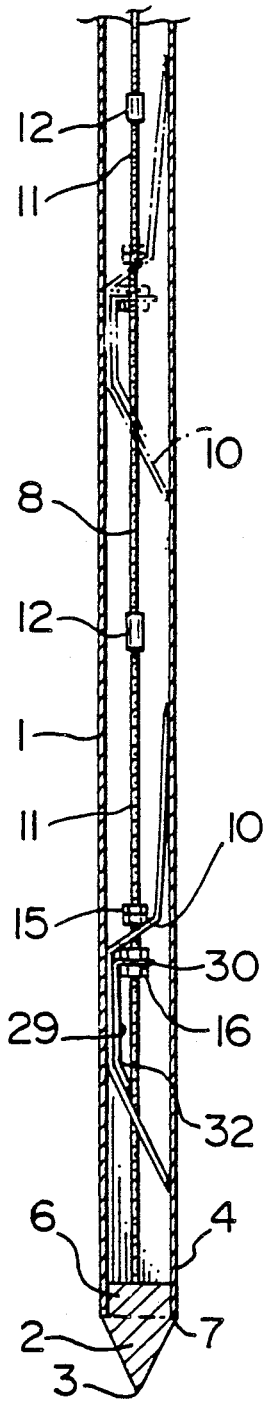
FIGS. 1 and 2 are longitudinal sectional views, at right angles to each other, of an anchor device for use in the barrier of the present invention.
Figure 2:
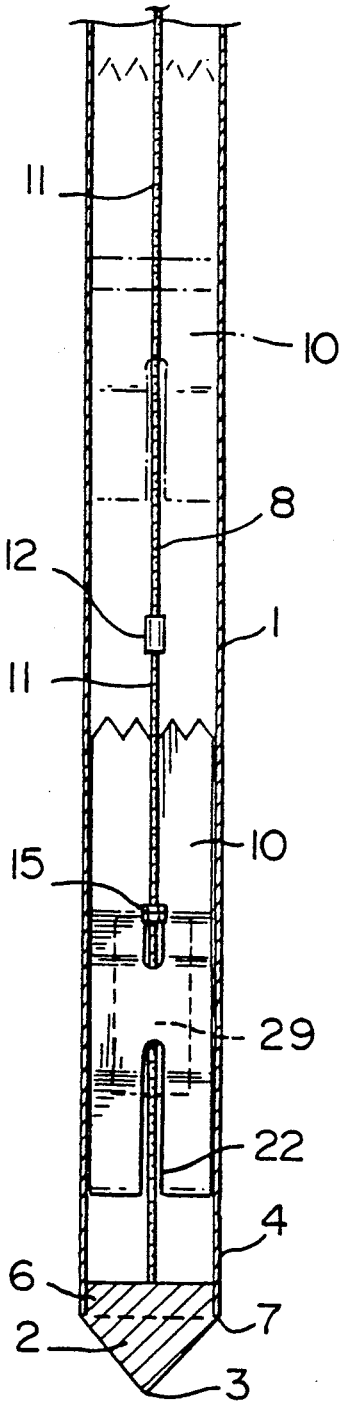

With reference to FIGS. 1 and 2, an anchor device for use in the barrier of the present invention includes an elongated metal sleeve 1 of rectangular cross section. A blade 2 with a pointed bottom end 3 is releasably mounted in the bottom end of the sleeve 1 facilitating hammering of the sleeve into the ground. The top end 6 of the blade has a reduced diameter for insertion into the bottom end 4 of the sleeve 1. A shoulder 7 at the bottom end of the reduced diameter portion 6 preventing the entry of material into the sleeve 1 when the device is hammered into the ground. A rod 8 carrying an anchor body 10 is slidably mounted in the sleeve 1. As suggested by the phantom outlines in FIGS. 1 and 2, the rod 8 can carry more than one anchor 10. The rod 8 is defined by a plurality of threaded sections 11 interconnected by internally threaded couplers 12. When the anchor is being embedded a short distance in the ground, a single elongated, threaded rod section 11 can be used.

Figure 3:
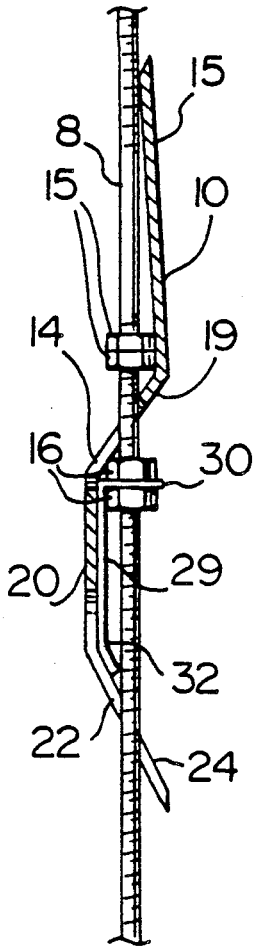
FIG. 3 is a longitudinal sectional view of a rod and anchor used in the device of FIGS. 1 and 2.
Figure 4:
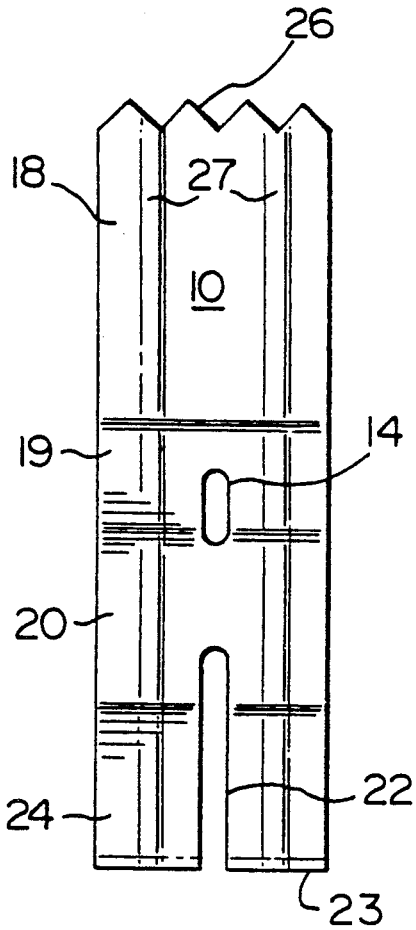
FIG. 4 is a front elevational view of the anchor of FIG. 3.

As best shown in FIGS. 3 and 4, the anchor 10 is defined by an elongated strip of metal with a slot 14 in the center thereof for pivotally mounting the anchor on the rod 8. The anchor 10 is maintained on the rod 8 by top and bottom nuts 15 and 16, respectively. The anchor 10 includes an upper leg 18 on one side of the rod 8, a centre section or portion 19 containing the slot 14 and straddling the rod 8, and a lower leg 20 extending outwardly and downwardly from the other side of the rod 8. The lower leg 20 includes an elongated central slot 22 extending upwardly from the bottom edge 23 of the anchor 10. The bottom free end 24 of such lower section 20 is bent into overlapping relationship with the rod 8 beneath the nuts 16, the slot 22 receiving the rod 8. The top end 26 of the anchor 10 is sharp and serrated, facilitating penetration of the soil. A pair of corrugations or ribs 27 extending longitudinally of the anchor 10 for strengthening the latter. A generally inverted L-shaped leaf spring 29 is mounted on the rod 8. One arm 30 (FIGS. 1 and 3) of the spring 29 is sandwiched between the two lower nuts 16. The other arm 32 of the spring extends downwardly against the inner surface of the lower leg 20 of the anchor body 10.

Figure 5:
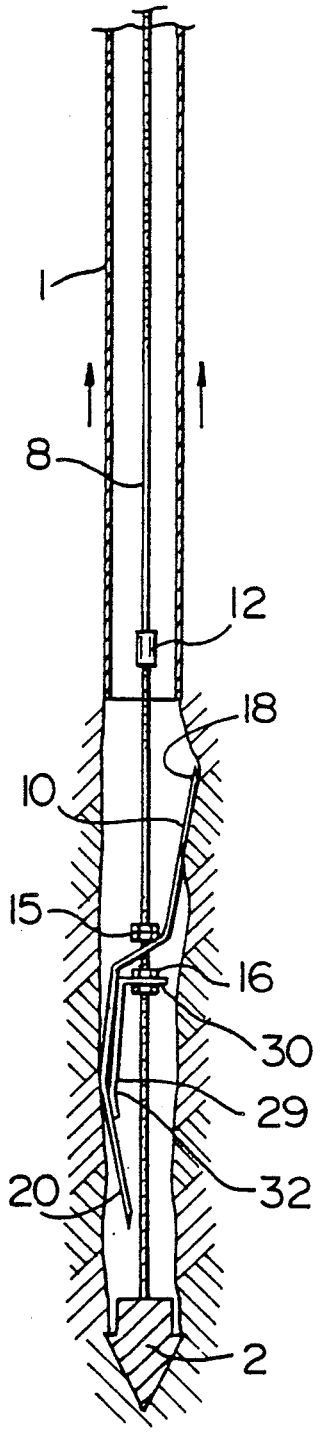
FIGS. 5 and 6 are longitudinal sectional views of a hole in the ground with the device of FIGS. 1 to 4 therein.
Figure 6:
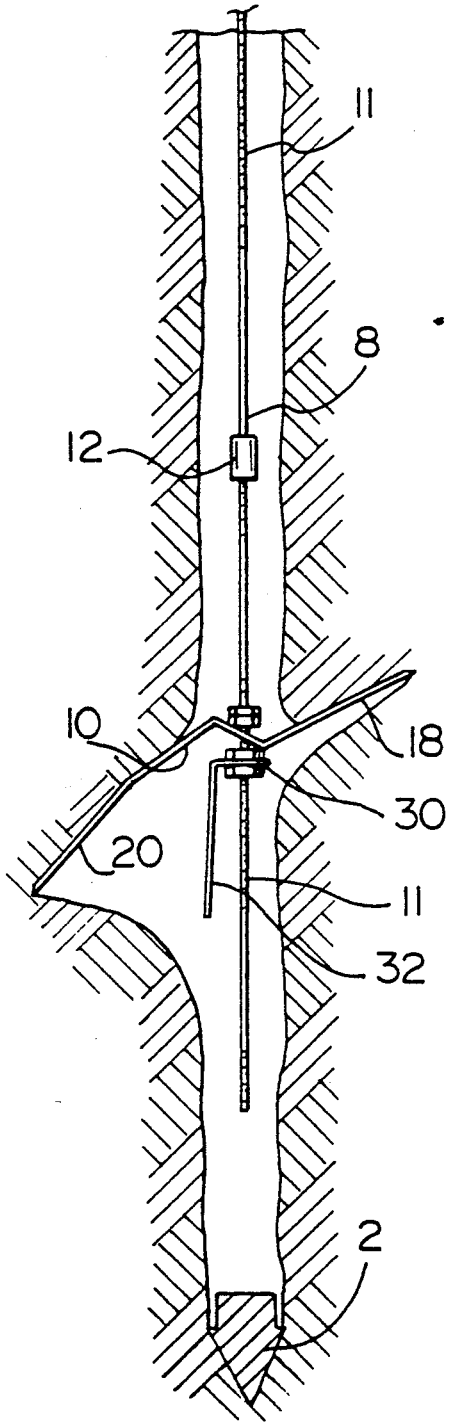

In use, one or more anchors 10 are mounted on the rod 8 and slid into the sleeve 1. When inserting the anchor 10 into the sleeve 1, it is necessary to press the legs 18 and 20 towards the rod 8, deforming or tensioning the spring 29. Thus, when the anchor 10 is located in the sleeve 1, the spring 29 biases the upper and lower legs 18 and 20, respectively of the anchor body 10 outwardly above the nuts 15 and below the nuts 16 against the walls of the sleeve 1. The sleeve 1 is hammered into the ground to the desired depth. While holding the rod 8 down, the sleeve 1 is pulled out of the ground (FIG. 5). When the anchor 10 is released by the sleeve 1, the spring 29 presses the upper and lower legs 18 and 20, respectively outwardly against the sides of the hole. If the rod 8 is pulled upwardly (FIG. 6) the free ends 23 and 26 of the anchor are pressed into the soil to firmly secure the anchor 10 in the ground.

Figure 7:
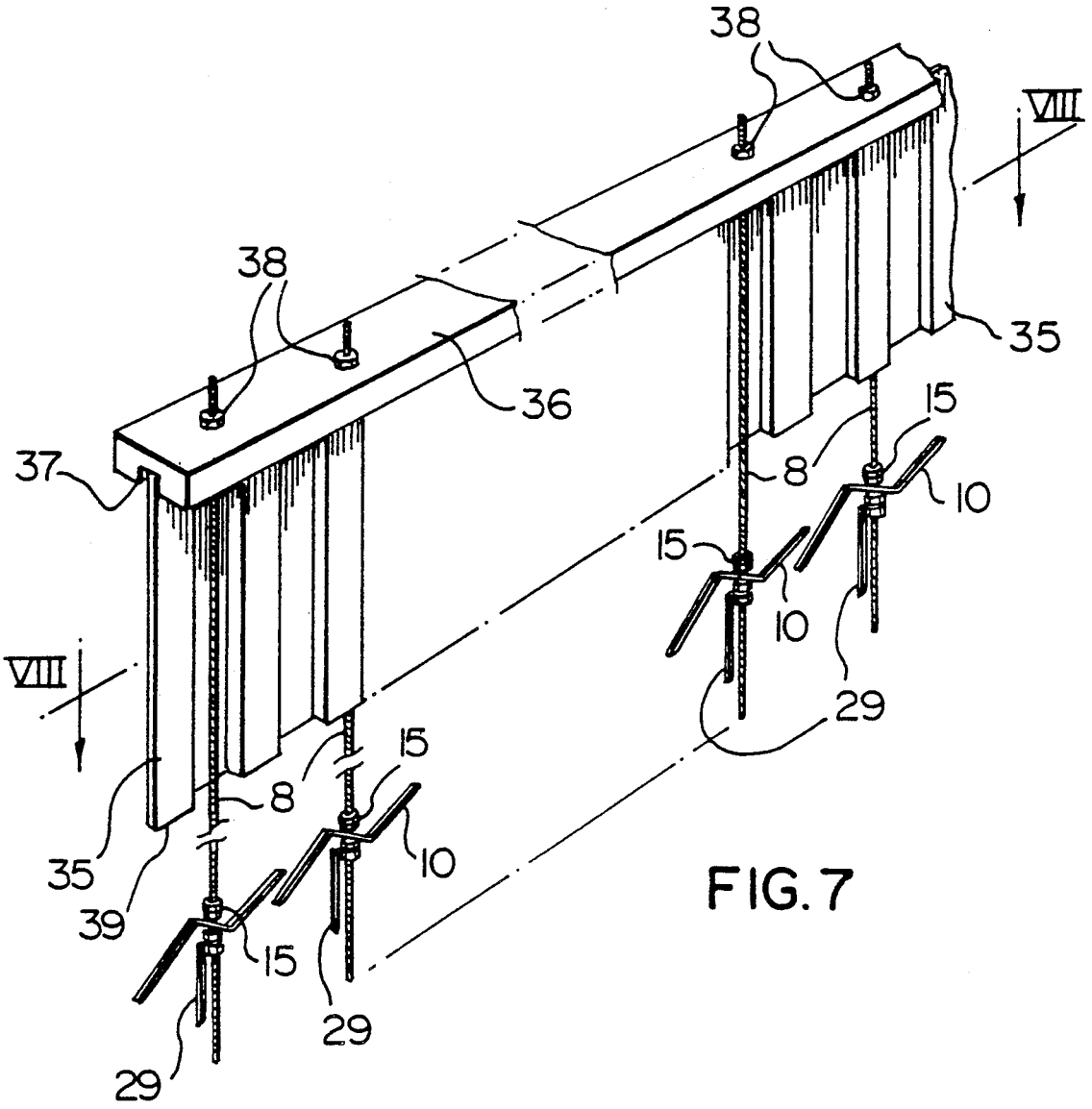
FIG. 7 is a schematic, perspective view of a barrier incorporating the device of FIGS. 1 to 4.
Figure 8:
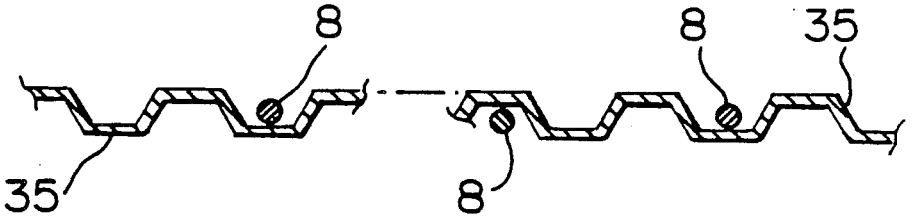
FIG. 8 is a cross section taken generally along line VIII—VIII of FIG. 7.

With reference to FIG. 7, one form of barrier in accordance with the present invention is formed using the anchor device described above in combination with a plurality of elongated, corrugated metal panels 35 and a top bar or cap 36. The earth anchors are embedded in the ground to define a wall, or a circle, rectangle or other closed FIGURE with the threaded rods 8 extending upwardly beyond the surface of the ground. The panels 35 are interconnected end-to-end against the rods 8 to form a wall or enclosure (not shown). The cap 36 is placed on the panels 35. For such purpose, a longitudinally extending slot 37 is provided in the bottom surface of the cap 36 for receiving the panels 35. It will be appreciated that the installation. The rods 8 extend through openings (not shown) in the cap 36, and nuts 38 are placed on the rods 8. By tightening the nuts 38, the panels 35 are forced downwardly into the ground to define a barrier. While not always necessary, a sharp bottom edge 39 on the panels 35 can be advantageous for facilitating movement of the panels 35 into the ground.

Figure 9:
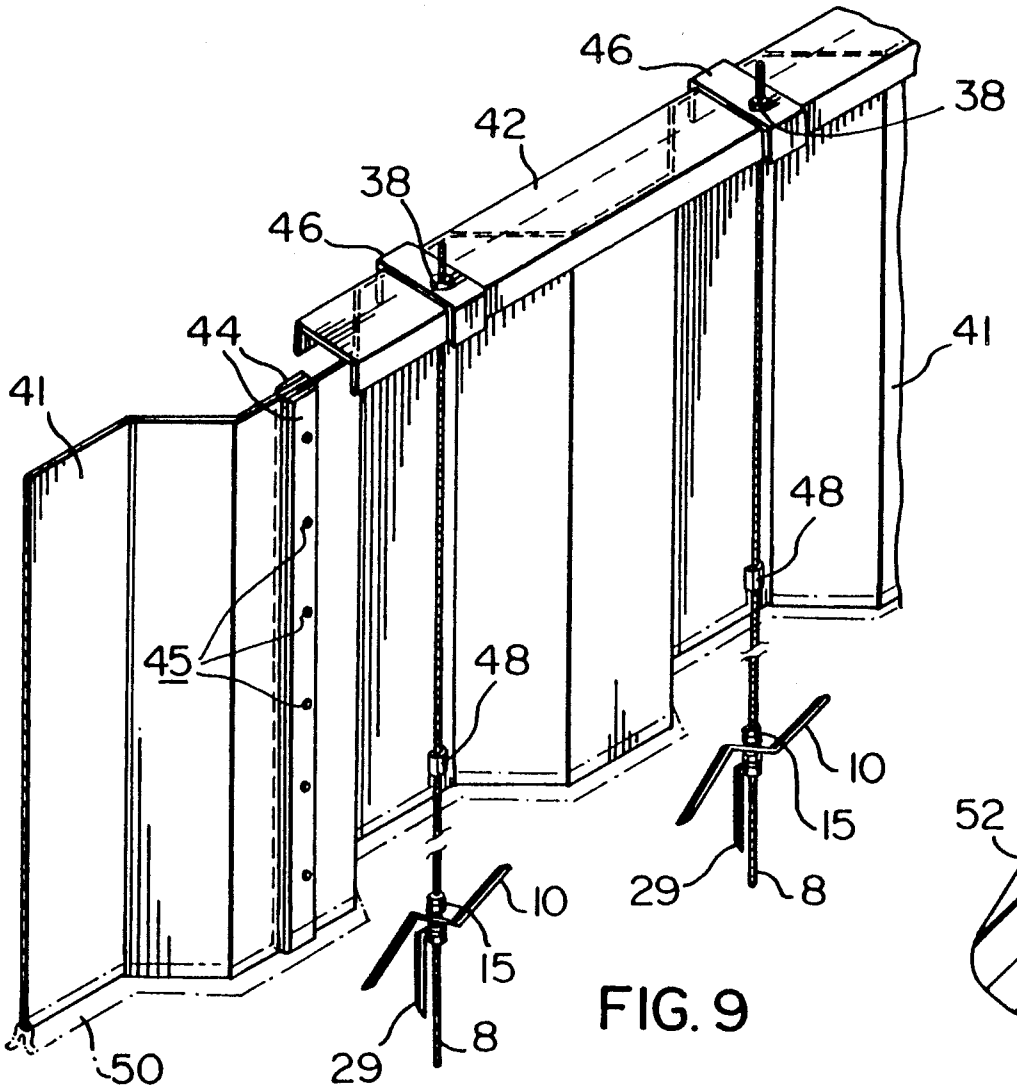
FIG. 9 is a perspective view of a section of a second type of barrier incorporating the device of FIGS. 1 to 4.

A second form of barrier in accordance with the invention is illustrated in FIG. 9. This barrier includes the anchor device described above, a plurality of elongated, corrugated metal panels 41 and caps defined by cover strips 42 (one shown) of generally C-shaped cross section. The panels 41 are interconnected in overlapping relationship by metal straps 44, bolts 45 and nuts (not shown). The strips 42 are placed on the panels 41, and C-shaped cross section brackets 46 are placed on the strips 42. The threaded rods 8 of the earth anchors extend downwardly through the brackets 46, and through sleeves 48 on the sides of the panels 41 proximate ground level. As in the case of the first embodiment of the invention, by tightening the nuts 38 on the rods 8, the panels 41 are forced downwardly into the ground to define a barrier.

Figure 10:
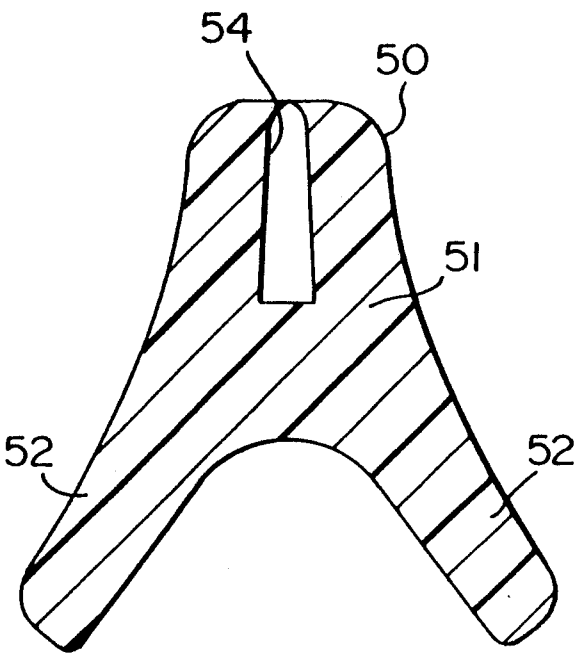
FIG. 10 is a cross sectional view of a sealing strip for use with the barrier of FIG. 9.

When a synthetic plastic liner (not shown) is provided within the barrier, i.e. as a floor in the containment area, a flexible plastic sealing strip 50 (FIG. 10) is provided on the bottom of the panels 41. The strip 50 includes an elongated body 51 with legs 52 extending downwardly and outwardly therefrom. An upwardly tapering slot 54 is provided in the top center of the body 51 for receiving the bottom ends of the panels 41 and of the straps 44.

Thus, there has been described a relatively simple barrier, which utilizes inexpensive materials, and which is easy to install.

WHAT I CLAIM IS:

1. A protective barrier comprising elongated panel means; cap means on said panel means; a plurality of threaded rod means for extending through said cap means into the ground; anchor means on said rod means for engaging the ground when said rod means is pulled upwardly; and nut means for mounting on the top end of said rod means above said cap means, whereby, when said anchor means is in a ground engaging position and the nut means is tightened, the nut means and cap means press said panel means into the ground.

2. A protective barrier according to claim 1, wherein said panel means is a corrugated metal pane.

3. A protective barrier according to claim 2, wherein said cap means includes an elongated bar for mounting on said panel means.

4. A protective barrier, according to claim 3, including slot means in the bottom surface of said bar for receiving said panel means.

5. A protective barrier according to claim 2, wherein said cap means includes an elongated strip of C-shaped cross section.

6. A protective barrier according to claim 5, including sleeve means on said panel means proximate the bottom end thereof for receiving said rod means and maintaining the rod means parallel to the panel means.

7. A protective barrier according to claim 6, including C-shaped bracket means for straddling the top of said strip and receiving the top end of said rod means.

8. A protective barrier according to claim 7, including resilient plastic sealing strip means for mounting on the bottom end of each said panel.

9. A protective barrier according to claim 8, wherein said sealing strip means includes a bifurcated lower end, and a slot in the top thereof for receiving the panel.

* * * * *